United States Patent [19]

Yanagida et al.

[11] 4,043,880

[45] Aug. 23, 1977

[54] METHOD FOR PRODUCING GREEN-COLORED ANODIC OXIDE FILM ON ALUMINUM OR ALUMINUM BASE ALLOY ARTICLES

[75] Inventors: Kiyomi Yanagida; Tadashi Hirokane; Tadashi Tsukiyasu; Tomoari Sato, all of Nagoya, Japan

[73] Assignee: Sumitomo Aluminum Smelting Co., Ltd., Osaka, Japan

[21] Appl. No.: 708,978

[22] Filed: July 26, 1976

[30] Foreign Application Priority Data

| | | |
|---|---|---|
| July 24, 1975 | Japan | 50-90848 |
| Feb. 25, 1976 | Japan | 51-20514 |

[51] Int. Cl.[2] ..... C25D 11/24

[52] U.S. Cl. ..... 204/35 N; 204/42; 204/38 A

[58] Field of Search ..... 204/35 N, 38 A, 42, 204/58

[56] References Cited

U.S. PATENT DOCUMENTS

| | | | |
|---|---|---|---|
| 1,988,012 | 1/1935 | Mason | 148/6 |
| 3,152,970 | 10/1964 | Jenson | 204/38 |
| 3,654,100 | 4/1972 | Nagai | 204/35 N |
| 3,661,729 | 5/1972 | Miyakawa | 204/35 N |
| 3,664,932 | 5/1972 | Patrie | 204/35 N |
| 3,704,209 | 11/1972 | Patrie | 204/35 N |
| 3,751,350 | 8/1973 | Ueki | 204/58 |
| 3,787,295 | 1/1974 | Endinger | 204/35 N |
| 3,795,590 | 3/1974 | Patrie | 204/35 N |
| 3,798,137 | 3/1974 | Kampert | 204/35 N |

*Primary Examiner*—G. L. Kaplan
*Assistant Examiner*—William T. Leader
*Attorney, Agent, or Firm*—Sughrue, Rothwell, Mion, Zinn and Macpeak

[57] ABSTRACT

A green-colored anodic oxide film on an aluminum or aluminum base alloy article is obtained by subjecting the article to alternating current anodization in an anodic oxidation bath containing sulfuric acid and then immersing the resulting article in an aqueous solution containing copper ions and an acid, followed by an aftertreatment.

22 Claims, No Drawings

METHOD FOR PRODUCING GREEN-COLORED ANODIC OXIDE FILM ON ALUMINUM OR ALUMINUM BASE ALLOY ARTICLES

BACKGROUND OF THE INVENTION

1. Field of the Invention

The present invention relates to a method for producing a colored anodic oxide film on an aluminum or aluminum base alloy article (hereinafter referred to, for brevity, as "aluminum"). More particularly, it relates to an improved method for producing a green-colored anodic oxide film on aluminum comprising an alternating current anodization of aluminum, an immersion of the anodized aluminum in an aqueous solution containing copper ions and an acid, and an aftertreatment.

2. Description of the Prior Art

Known methods for producing a colored anodic oxide film on the surface of aluminum include the following:

1. anodic oxidation of aluminum in an aqueous solution containing an organic acid (for example, as disclosed in U.S. Pat. No. 3,031,387);

2. alternating or direct current electrolysis of previously anodized aluminum in an aqueous solution containing metallic ions (for example, as disclosed in U.S. Pat. Nos. 3,382,160 and 3,761,362); and 3. dyeing an anodic oxide film on aluminum with a dye or pigment.

In methods (1) and (2), the colors obtained are limited and a green-colored oxide film cannot be obtained. Method (3) provides a wide range of colors; however, the product has poor resistance to weathering and cannot be used as building materials for outdoor uses.

On the other hand, there are known methods for producing a green-colored anodic oxide film on aluminum which has good resistance to weathering. One method comprises anodically oxidizing aluminum in an aqueous solution containing sulfuric acid and copper sulfate with an alternating current superimposed on a direct current (Japanese Patent Publication No. 27,490/1974). In this method, however, deposition of copper on a cathode easily occurs due to the use of the alternating current superimposed on the direct current, which not only leads to ageing of the electrolytic bath within a relatively short time but also to difficulty of bath control. This method is, therefore, sometimes disadvantageous on industrial scale operation from the economical point of view.

Another method for producing a green-colored anodic oxide film comprises subjecting aluminum to an alternating current anodization, with the aluminum as one electrode, in an aqueous sulfuric acid solution containing a water soluble metal compound (U.S. Pat. No. 3,717,555). This method provides a green-colored anodic oxide film having good resistance to weathering when a copper salt is used as the water soluble metal compound and a sealing treatment is performed after the alternating current anodization. This method, however, includes the following various problems which must be taken into account. The operational efficiency of the method is poor because only one electrode is aluminum and growth and coloration of the anode oxide film proceed at the same time due to the electrolysis; while the simultaneous progress of these two processes is very advantageous, the depth of the resulting coloration is limited by the film thickness. Further, the film formation efficiency is lower in alternating current anodization than in a conventional direct current anodization. Therefore, while it is possible to deepen the green shade by increasing the film thickness, when the desired thickness is increased beyond a certain level the operational costs become high, and, further, the surface of the resulting anodically oxidized film on the aluminum becomes very rough, which cannot provide a sound film. Finally, this method produces a clear green shade only with relative difficulty and it sometimes produces a yellowish, pale green shade unless operational conditions are strictly controlled.

A further method is disclosed in Metal Finishing Journal, April 1974, pages 80 – 84, wherein a green-colored anodic oxide film is obtained by subjecting aluminum to an alternating current anodization in an aqueous sulfuric acid solution and then immersing the aluminum in an aqueous copper sulfate solution followed by a sealing treatment. This method also provides an anodic oxide film of excellent resistance to weathering, but the green shade obtained is relatively pale, and, in most cases, strongly yellowish, because the immersion bath contains only copper sulfate. Further, shade reproducibility is very poor.

On the other hand, it is known that a sound, thick, green-colored oxide film can be obtained by subjecting aluminum to direct current anodization and then to an alternating current anodization and immersing the anodized aluminum in an aqueous solution containing a copper salt followed by a sealing treatment (Japanese Patent Publication No. 14,624/1975). This method, however, yields a deep shade only with difficulty.

As described above, there are well known methods which produce green-colored anodic oxide film having excellent resistance to weathering, but they all have problems in practical use.

SUMMARY OF THE INVENTION

As a result of extensive research to overcome the difficulties of the prior art, it was found by the inventors that, in the method of producing a green-colored anodic oxide film on an aluminum or aluminum alloy article comprising subjecting aluminum to an alternating current anodization in an aqueous sulfuric acid solution and immersing the anodized aluminum in an aqueous solution containing copper ions followed by an aftertreatment, such as a conventional sealing treatment, a clear, deep green-colored oxide film can be obtained with ease and with good reproducibility by the presence of an acid in addition to the copper ions in the immersion bath which follows the alternating current anodization.

Furthermore, it was also found that the film thickness can be increased without deteriorating film properties by subjecting the aluminum, after alternating current anodization but prior to the immersion treatment, to a direct current anodization.

Consequently, one object of the present invention is to provide a method for producing a clear, deep green-colored, uniform anodically oxidized film having excellent corrosion resistance on an aluminum surface.

Another object of the present invention is to provide an economical method for producing a green-colored anodic oxide film on aluminum in a reproducible manner.

A further object of the present invention is to provide a method for coloring an anodic oxide film on aluminum a clear, deep green shade, irrespective of the film thickness, and with the film in sound condition.

The present invention provides a method for producing a green-colored anodically oxidized film on aluminum by subjecting aluminum to an alternating current anodization in an anodic oxidation bath containing sulfuric acid as a main component and immersing the resulting anodized aluminum in an aqueous solution containing copper ions and an acid, followed by an aftertreatment.

In a modification of the above method, the present invention provides another method for producing a green-colored anodically oxidized film on aluminum by subjecting aluminum to an alternating current anodization and then to a direct current anodization in an anodic oxidation bath containing sulfuric acid as a main component, and then immersing the resulting anodized aluminum in an aqueous solution containing copper ions and an acid, followed by an aftertreatment.

DETAILED DESCRIPTION OF THE INVENTION

The present invention will now be illustrated in more detail.

Sulfuric acid is the main component of the anodic oxidation bath used in the present invention, and its preferred concentration is about 10 to about 30% by weight from the standpoints of favorable electrolysis operation and obtaining a sound film. Concentrations outside this range are, of course, useful in the present invention, but the film obtained easily becomes uneven.

The anodic oxidation bath may contain a small amount of an organic acid such as oxalic acid, an aromatic sulfonic acid or the like. For example, when the bath contains oxalic acid at about 1% by weight, it produces a yellowish green-colored oxide film.

Further, as the anodization is repeatedly conducted using the same bath, the aluminum is increasingly dissolved in the bath to elevate the aluminum ion concentration. However, the coloring of the anodic oxide film is not affected by the concentration of aluminum ions at all. However, the electrical conductivity of the bath tends to decrease with increased aluminum ion concentrations, and, therefore, it is desirable to control the aluminum ion concentration to a level of about 30 g/l or less from the viewpoint of preferred anodization and bath control.

If desired, the anodic oxidation bath may contain copper ions. which serve to make the green shade deeper and clearer by the subsequent immersion treatment and aftertreatment. In this case, the concentration of copper ions is about 4 to about 400 ppm, preferably 40 to 200 ppm, in the anodic oxidation bath.

Turning now to the alternating current anodization, the term "alternating current" referred to herein includes those as are conventionally used in the art, e.g., normal sine wave and distorted sine wave alternating currents, and, further, all currents of a specific wave type, for example, an alternating current superimposed on a direct current, if the direction of the currents is reversed periodically.

With respect to the current density and electrolysis time, there are film thickness determining factors and may take any value so far as the resulting anodic oxide film is more than about 4 microns in thickness, and, at the same time, is sound and uniform. However, when the current density is too large, electric current tends to concentrate at the contact area where the current is supplied to the article, and operation becomes unstable, while, on the other hand, too low a current density lowers the operational efficiency. Consequently, it is desirable to maintain the current density at about 2 to about 10A/dm$^2$. Further, an electrolysis time of about 10 to about 60 minutes is preferred.

The electrolysis voltage tends to become high as the current density becomes large and the electrolysis time becomes long. However, local dissolution of anodic oxide film occurs only with difficulty if the voltage is controlled so as to not exceed about 40 volts but be greater than about 5 volts.

The electrolyte temperature can be subjected to wide variation, with a range of about 10° to about 40° C being generally applicable, and is preferably in the vicinity of room temperature, for example, 15° to 30° C. Further, in the case of alternating current anodization, a pair of aluminum electrodes is preferred from the viewpoint of operational efficiency.

When this alternating current anodization is used for the formation of an anodically oxidized film of a large thickness, for example, about 20 microns, operation costs become high, and, moreover, the film surface becomes rough, whereby a sound film can be obtained only with difficulty, as in the case of the process described in U.S. Pat. No. 3,717,555 or Metal Finishing Journal, April 1974, pp. 80 – 84. However, these problems can be avoided by using a two layer film, which comprises an alternating current anodized film as an outer layer and a direct current anodized film as an inner layer, on aluminum. That is, by performing alternating current anodization and then direct current anodization, a thick anodized film can be obtained with relatively low operational costs, and, at the same time, the film obtained is sound. Furthermore, by the subsequent coloring treatment, the film can be colored the same stable, uniform, deep green shade as obtained by alternating current anodization only. When the order of these two anodizations is reversed, that is, the direct current anodization precedes the alternating current anodization, only a very pale green shade is obtained.

The proportion of these two layers in the two layer film depends upon the depth of shading and the thickness and soundness of the resulting anodically oxidized two layer film which is desired. Assuming the total thickness of the two layer film is kept constant, the larger the proportion of the alternating current anodized layer, the deeper the shade of the anodically oxidized film. One the other hand, the direct current anodization is far superior in film formation efficiency, and, as described above, an increase in film thickness by alternating current anodization leads to high operational costs and loss of the soundness of the resulting film. Taking these points into account, it is preferred to select the current density and electrolysis time in the alternating current and direct current anodization processes so that the ratio of the film thickness due to the latter process to that due to the former process is about 0.1 to about 10, preferably 0.5 to 2.

Consequently, the operational conditions of the direct current anodization following the alternating current anodization are not particularly limited. However, it is preferred, from the standpoints of operational efficiency and stability, to select a current density of about 0.5 to about 5A/dm$^2$ and an electrolysis time of about 5 to about 60 minutes. The electrolyte temperature may be on the same order as that of the alternating current anodization.

The anodic oxidation bath used for the direct current anodization contains sulfuric acid as a main component in an amount as in the case of the alternating current anodization. The bath composition is properly selected within the range of earlier described above, but need not be the same as that of the alternating current anodization bath. On industrial scale anodizing, however, it is preferred to carry out both anodizings in the same anodizing bath because operation is simple with a mere switching between an alternating current supply and a direct current supply.

On the other hand, while the alternating current anodic oxidation baty may contain copper ions as described above, when the direct current anodic oxidation bath contains copper ions, copper is deposited on the cathode. In the case of using copper ions, therefore, it is preferred to prepare two anodic oxidation baths and to carry out the alternating current anodization in a bath containing copper ions and the direct current anodization in a bath containing substantially no copper ions.

In the present invention, an increase in the thickness of the anodically oxidized film is desirably attained by carrying out direct current anodization after alternating current anodization. However, when the required film thickness is as small as about 10 microns, it is, of course, sufficiently attained by the alternating current anodization alone.

The thus anodized aluminum is rinsed and then immersed in an aqueous solution containing copper ions and an acid. The copper ions are preferably introduced into the immersion bath by dissolving a water soluble copper salt, for example, copper sulfate, copper nitrate, copper acetate or copper chloride, in water. Among those copper salts, copper sulfate and copper nitrate are particularly preferred. Alternatively, metallic copper may be dissolved in an acid. The copper ion concentration of any aqueous solution used for the immersion treatment is preferably about 0.04 to about 200 g/l. When the concentration is less than about 0.04 g/l, the green shade obtained is very pale, while a concentration of more than about 200 g/l comes very close to the saturation value of copper salts. When a deep shade is particularly desired, a concentration of 2 to 50 g/l is suitable. The copper ions may be cuprous ions and/or cupric ions. However, since cuprous ions produce a green shade which is yellowish to some extent, cupric ions are preferred.

The immersion bath must contain an acid, and an immersion bath containing copper ions alone does not produce a clear green shade but rather a strongly yellowish, pale green shade. Further, such a bath is very poor in color reproducibility because it is very difficult to obtain films having the same shade in a consistent fashion on an industrial scale. The addition of an acid to the bath yields an anodic oxide film having a highly reproducible, clear deep green shade.

Although the coloring mechanism and the function of the acid in the immersion bath are not yet clear at many points, the following may be drawn from various experiments.

On comparing the alternating current anodized film with a direct current anodized film, both of which have been subjected, under the same conditions, to the immersion treatment in an aqueous solution containing copper ions and then to the after-treatment, the former is colored green while the latter is not colored at all. From the fact that the former, in general, contains a large amount of active sulfur, it may be thought that the sulfur plays a very important role in the coloring process.

Next, in a series of processes wherein alternating current anodized aluminum is immersed in an aqueous solution containing copper ions and is then subjected to a sealing treatment in boiling water, the effects of immersion baths, one containing an acid, the other containing no acid, were compared. Firstly, the aluminum taken out of either immersion bath was colored yellow, but the one taken out of the acid containing bath had a deeper shade. Secondly, a faint odor of hydrogen sulfide was detected upon the sealing treatment, but the treatment of the aluminum taken out of the acid containing bath had a stronger odor. Consequently, it may be thought that the acid in the immersion bath served to increase the amount of the copper ions adsorbed to the anodic oxide film and that, upon the sealing treatment wherein the yellow color changed to a green color, the acid and the active sulfur in the oxide film cooperated to promote the coloring reaction.

As described above, the effect of the addition of acid in the present invention is remarkably observed from the facts that the anodic oxide film is colored a clear green, the green color is deepened and that color reproducibility is very good.

The above phenomenon is entirely opposed to the well known one encountered in the aforesaid U.S. Pat. No. 3,717,555 which discloses that, in a process comprising subjecting aluminum to an alternating current anodization in an aqueous sulfuric acid solution containing a water soluble copper salt and carrying out a sealing treatment, the green color can be deepened by immersing the anodized aluminum in an ammonia solution prior to the sealing treatment.

The acids used in the present invention include an inorganic acid, preferably a mineral acid such as sulfuric acid, nitric acid, hydrochloric acid, phosphoric acid and the like, and an organic acid, preferably an organic sulfonic acid, most preferably an aromatic sulfonic acid, e.g., sulfosalicyclic acid, naphthalene disulfonic acid and the like. However, sulfuric acid is most preferred in terms of coloring, bath control and economy.

The concentration of the acid in the bath is not particularly limited, and generally is in the range of about 0.5 to about 30% by weight. However, taking ease of operation and economy of the treatment into account, a concentration of 1 to 20% by weight is most suitable.

A suitable bath temperature is in the range of about 10° to about 60° C, and the optimum temperature varies with the copper ion concentration and the acid concentration of the bath. When the copper ion concentration is low, a relatively high temperature, for example, 30° to 50° C, is suitable. When the concentration is relatively high, a low temperature, for example, 20° to 30° C, is suitable.

With respect to the acid concentration, a relatively high bath temperature is suitable for a low concentration while a relatively low bath temperature is suitable for a high concentration.

The period of time during which the anodized aluminum is immersed in the bath is properly selected depending upon the copper ion concentration, the acid concentration, the temperature of the bath and the desired shade. A period of about 3 to about 30 minutes is suitable in terms of operational efficiency.

Further, when the shade easily becomes uneven due to processing aluminum of complicated shapes, it is desirable to add a surfactant to the bath.

In this way, aluminum undergoes the immersion treatment in an aqueous solution containing copper ions and an acid, and then it is rinsed. At this stage, the color of the anodically oxidized film is almost yellow, but it changes to green by the subsequent aftertreatment.

The aftertreatment referred to herein is a sealing treatment as is conventionally applied to an anodically oxidized film of aluminum. The treatment includes a boiling water treatment, a steam treatment and a heat treatment in an aqueous solution containing an amine such as ethanolamine. This treatment of the present invention is, however, different from the conventional ones in that the development of a green color is attained in a very short time, that is, the yellow color of anodically oxidized film begins to change to green as soon as this treatment is applied and the green-colored oxidized film can be obtained in only about 2 minutes by the boiling water treatment. However, the period of time may be extended to the same order as in conventional sealing treatments, for example, about 60 minutes, taking corrosion resistance into account.

The green film thus obtained has excellent resistances to corrosion and weathering. Further, when the film is coated with a clear paint by a conventional electrodeposition coating, dip coating or electrostatic coating, it becomes clearer and increases in decorative effect so that it can be used in a wide range of fields, including building materials.

The present invention will now be illustrated in more detail by the following Examples, which are not intended to limit the present invention thereto. Unless otherwise indicated, all parts, percentages, ratios and the like are by weight.

EXAMPLE 1

An extruded article of aluminum base alloy 6063 (A.A. designation) was immersed in a 10% aqueous sodium hydroxide solution at 60° C for 1 minute and then dipped in a 20% nitric acid solution at room temperature for 1 minute for neutralization, followed by rinsing in water. Two pieces of the aluminum sample thus prepared were installed as the electrodes in a 15% aqueous sulfuric acid solution and subjected to alternating current anodization at a current density of 6A/dm$^2$ for 20 minutes at an electrolyte temperature of 20° ± 1° C.

Therefore, these aluminum pieces were rinsed with water and then immersed, at 45° C for 5 minutes, in a 1% aqueous sulfuric acid solution containing 10 g/l copper sulfate. After rinsing with water, the aluminum was then subjected to a sealing treatment by immersion in boiling water for 15 minutes. Thus, aluminum having a green colored anodic oxide film thereon was obtained.

On the other hand, the alternating current anodized aluminum piece described above was treated in the same manner as above, except that the piece was immersed in an aqueous solution containing 10 g/l copper sulfate but free of acid. The developed color on the aluminum was very close to yellow and it had only a slight greenish tint. This means that the aqueous solution containing both copper sulfate and surfuric acid is more suitable to obtain a clear green color having no yellowish tint.

Both green colored anodic oxide films had a thickness of 10 microns.

EXAMPLE 2

Two pieces of aluminum plate (purity 99.7%) were subjected to pre-treatments under the same conditions as in Example 1 and then installed as the electrodes in an 18% aqueous sulfuric acid solution. The plates were then subjected to the alternating current anodization at a current density of 4A/dm$^2$ at 15° C for 30 minutes. After rinsing with water, the plates were immersed, at 30° C for 30 minutes, in a 10% aqueous sulfuric acid solution containing 0.5 g/l copper sulfate, removed and further rinsed with water and then subjected to a sealing treatment by immersion in boiling water for 30 minutes. Thus, a green colored anodic oxide film 10 microns thick was obtained.

EXAMPLE 3

Two pieces of aluminum plate (purity 99.7%) were prepared by pre-treating under the same conditions as in Example 1. The two pieces were installed as the electrodes in an aqueous solution containing 20% sulfuric acid and 1% oxalic acid and subjected to the alternating current anodization at a current density of 8A/dm$^2$ at 30° ± 1° C for 20 minutes. After rinsing with water for 10 minutes, the plate was immersed, at 20° C for 30 minutes, in a 5% aqueous nitric acid solution containing 20 g/l of copper sulfate, removed and further rinsed with water and then subjected to a sealing treatment by immersion in boiling water for 15 minutes. A green colored anodic oxide film having a thickness of 13 microns was thus obtained.

EXAMPLE 4

Two pieces of aluminum plate (purity 99.7%) were pretreated under the same conditions as in Example 1. The two samples were installed as the electrodes in a 15% aqueous sulfuric acid solution and subjected to the alternating current anodization at a current density of 3A/dm$^2$ at 20° ± 1° C for 30 minutes. After rinsing with water, the plates were immersed, at 50° C for 15 minutes, in a 2% aqueous nitric acid solution containing 40 g/l of copper nitrate, removed and further rinsed with water and then subjected to a sealing treatment by immersion in boiling water for 5 minutes. Thus, a green colored oxide film 7 microns thick was obtained.

EXAMPLE 5

Two pieces of aluminum plate (purity 99.7%) were pretreated under the same conditions as in Example 1 and installed as the electrodes in a 15% aqueous sulfuric acid solution. The plates were subjected to the alternating current anodization at a current density of 6A/dm$^2$ at 20° ± 1° C for 20 minutes. After rinsing with water, the plates were immersed, at 25° C for 20 minutes, in a 10% aqueous naphthalene disulfonic acid solution containing 50 g/l of copper sulfate, removed and further rinsed with water and then sealed by immersion of water at 90° C for 30 minutes. A green colored anodic oxide film 10 microns thick was thus obtained.

EXAMPLE 6

An aluminum extrusion (6063) was immersed in a 10% aqueous sodium hydroxide solution at 50° C for 3 minutes and then dipped in a 25% nitric acid solution at room temperature for 3 minutes for neutralization, followed by rinsing in water. Two pieces of the aluminum sample thus prepared were installed as the electrodes in an aqueous solution containing 15% sulfuric acid and 0.3 g/l of copper sulfate, and then subjected to the alternating current anodization at a current density of 6.0 A/dm$^2$ at 20° ± 1° C for 20 minutes. After rinsing with water, the plates were immersed in an aqueous solution containing 50 g/l of copper sulfate and 2% sulfuric acid at 20° C for 30 minutes and then subjected to a sealing treatment by immersion in boiling water for 15 minutes. A green colored film having a thickness of 10 microns was thus obtained.

EXAMPLE 7

Two pieces of aluminum extrusion (6063) were subjected to pre-treatments under the same conditions as in Example 1 and then installed as the electrodes in a 15% aqueous sulfuric acid solution. The aluminum pieces were subjected to the alternating current anodization at a current density of 6A/dm² at 20° ± 1° C for 20 minutes. Next, the direct current anodization was carried out, with the two pieces of aluminum as an anode and a carbon plate as a counter-electrode, at a current density of 2A/dm² at a temperature of 20° ± 1° C for 15 minutes. After rinsing with water, the aluminum was immersed, at 45° C for 5 minutes, in a 1% aqueous sulfuric acid solution containing 10 g/l of copper sulfate, removed and further thoroughly rinsed with water and then subjected to a sealing treatment by immersion in boiling water for 15 minutes. A green colored oxide film 21 microns thick was thus obtained.

On the other hand, the same conditions were used but the order of the two anodization treatments was reversed, and it was found that the resulting green colored oxide film had the same thickness (21 microns) but that the shade thereof was much paler.

Further, pre-treated aluminum as above was treated in the same manner as described above, except that the direct current anoidization was not carried out and the alternating current anodization was carried out at a current density of 6A/dm² at 20° ± 1° C for 40 minutes. The green colored oxide film thus obtained had a thickness of 20 microns, but the film surface was very rough and not suitable for practical use.

EXAMPLE 8

Two pieces of aluminum plate (purity 99.7%) were subjected to pre-treatments under the same conditions as in Example 1. The two plates were installed as the electrodes in an 18% aqueous sulfuric acid solution and subjected to the alternating current anodization at a current density of 4A/dm² at 18° C for 40 minutes. Thereafter, the direct current anodization was carried out, with the two plates as an anode and a lead plate as a counter-electrode, in an aqueous solution containing 20% sulfuric acid and 1% oxalic acid. The current density, electrolyte temperature and electrolysis time were 1A/dm², 15° ± 1° C and 30 minutes, respectively. After rinsing with water, the aluminum was immersed in a 1% aqueous nitric acid solution containing 15 g/l of copper nitrate at 40° C for 7 minutes, further rinsed with water and then subjected to a sealing treatment by immersion in boiling water for 30 minutes. A green colored oxide film having a thickness of 24 microns was thus obtained.

While the invention has been described in detail and with reference to specific embodiments thereof, it will be apparent to one skilled in the art that various changes and modifications can be made therein without departing from the spirit and scope thereof.

What is claimed is:

1. In a method for producing a green colored anodic oxide film on an aluminum or aluminum alloy article which comprises subjecting said article to alternating current anodization in an anodic oxidation bath containing sulfuric acid, then subjecting said anodized article to an immersion treatment into an aqueous immersion bath containing copper ions, and thereafter subjecting said immersed article to an aftertreatment, the improvement wherein said immersion bath further contains an acid.

2. The method according to claim 1, wherein said alternating current anodization is effected by applying said aluminum or aluminum alloy article as both electrodes.

3. The method according to claim 1, wherein the concentration of sulfuric acid in said anodic oxidation bath is from about 10 to about 30% by weight.

4. The method according to claim 1, wherein said anodic oxidation bath further contains an organic acid.

5. The method according to claim 1, wherein said anodic oxidation bath further contains copper ions.

6. The method according to claim 5, wherein the concentration of copper ions in said anodic oxidation bath is from about 4 to about 400 ppm.

7. The method according to claim 1, wherein said alternating current anodization is carried out at a current density of from about 2 to about 10A/dm² and for a period of time of from about 10 to about 60 minutes.

8. The method according to claim 1, wherein said copper ions in said immersion bath are added as a water soluble copper salt.

9. The method according to claim 8, wherein said water soluble copper salt is copper sulfate or copper nitrate.

10. The method according to claim 1, wherein the concentration of copper ions in said immersion bath is from about 0.04 to about 200 g/l.

11. The method according to claim 1, wherein said acid in said immersion bath is sulfuric acid, nitric acid, hydrochloric acid, phosphoric acid, sulfosalicyclic acid or naphthalene dilsulfonic acid.

12. The method according to claim 1, wherein the concentration of said acid in said immersion bath is from about 0.5 to about 30% by weight.

13. The method according to claim 1, wherein said immersion treatment is carried out at a temperature of from about 10° to about 60° C and for a period of time of from about 3 to about 30 minutes.

14. The method according to claim 1, wherein said immersion bath further contains a surfactant.

15. The method according to claim 1, wherein said aftertreatment is a sealing treatment.

16. The method according to claim 15, wherein said sealing treatment is a boiling water treatment, a steam treatment or a heat treatment in an aqueous solution containing an amine.

17. The method according to claim 15, wherein said sealing treatment is conducted for a period of time of from about 2 to about 60 minutes.

18. In a method for producing a green colored anodic oxide film on an aluminum or aluminum alloy article which comprises subjecting said article to an alternating current anodization in an anodic oxidation bath containing sulfuric acid, then subjecting said anodized article to an immersion treatment into an aqueous immersion bath containing copper ions, and thereafter subjecting said immersion article to an aftertreatment, the improvement wherein said alternating current anodized article is then subjected to a direct current anodization in an anodic oxidation bath containing sulfuric acid and said immersion bath further contains an acid.

19. The method according to claim 18, wherein the ratio of the thickness of the anodized film resulting from said direct current anodization to the thickness of the anodized film resulting from said alternating current anodization is from about 0.1 to about 10.

20. The method according to claim 18, wherein said alternating current anodization is carried out at a current density of from about 2 to about 10 $A/dm^2$ and for a period of time of from about 10 to about 60 minutes, and said direct current anodization is carried out at a current density of from about 0.5 to about 5 $A/dm^2$ and for a period of time of from about 5 to about 60 minutes.

21. The method according to claim 18, wherein said alternating current anodization and said direct current anodization are carried out substantially in the same anodic oxidation bath.

22. The method according to claim 18, wherein said alternating current anodization is carried out in an anodic oxidation bath further containing copper ions, and said direct current anodization is carried out in an anodic oxidation bath substantially not containing copper ions.

* * * * *